United States Patent [19]

Alberto et al.

[11] 4,277,032

[45] Jul. 7, 1981

[54] AUTOMATIC APPARATUS FOR CONTINUOUSLY FORMING CLOTH ROLLS

[76] Inventors: Pietro Alberto, Via Lamarmora, 16; Giorgio Meneghetti, Via Schiapparelli, 12, both of Biella, Italy

[21] Appl. No.: 97,638

[22] Filed: Nov. 27, 1979

[30] Foreign Application Priority Data

Nov. 29, 1978 [IT] Italy ..... 30325 A/78

[51] Int. Cl.[3] ..... B65H 19/26

[52] U.S. Cl. ..... 242/56 R

[58] Field of Search ..... 242/56 R, 56 A, 67.1 R, 242/66

[56] References Cited

U.S. PATENT DOCUMENTS

| | | | |
|---|---|---|---|
| 3,167,268 | 1/1965 | Birch | 242/56 R |
| 3,386,678 | 6/1968 | Malone | 242/56 R |
| 3,539,125 | 11/1970 | Patriksson | 242/56 R |
| 3,782,664 | 1/1974 | Alberto | 242/56 R |
| 3,908,924 | 9/1975 | Schulze | 242/56 R |
| 4,128,212 | 12/1978 | Birch | 242/56 R |

*Primary Examiner*—Edward J. McCarthy
*Attorney, Agent, or Firm*—Finnegan, Henderson, Farabow, Garrett & Dunner

[57] ABSTRACT

An automatic apparatus for continuously forming cloth rolls of a selected length from great size rolls or continuous bands made of a number of cloth pieces sewn together, comprises a detecting means such as a photocell responsive to a seam between two adjoining pieces, positioned upstream of a measuring station which in turn is upstream of a cutting station. Selected advancements of the cloth and corresponding cutting operations are actuated by known automatic devices which are disabled whenever the above-mentioned detecting means senses a seam between two pieces sewn together. Another detecting means such as photocell in correspondence of the measuring station causes the cloth to stop as soon as a seam has reached this position, being preset to this operation by the first-mentioned photocell. With the automatic advancement disabled, the cloth is caused to advance, after the stop, by a fixed length corresponding to the distance between the measuring station and the cutting station. A tube feeding station is also provided for supplying each time a tube being the core of a new roll to be formed, from a tube magazine at a winding station. There are also provided devices for bending the leading edge of the cut cloth around an empty tube, causing this edge to adhere thereon without formation of pleats and discharging finished roll.

15 Claims, 11 Drawing Figures

AUTOMATIC APPARATUS FOR CONTINUOUSLY FORMING CLOTH ROLLS

BACKGROUND OF THE INVENTION

The present invention relates to an automatic apparatus for continuously forming cloth rolls.

More in particular the object of the present invention is to provide an automatic apparatus for forming cloth rolls of the type disclosed and claimed by U.S. Pat. No. 3,782,664.

By the apparatus being the object of the above-mentioned patent, the problem of continuously forming, without any operator's intervention, cloth rolls of a selected constant length has been solved, thus obtaining a particularly high production. The main advantage afforded by such an apparatus, besides the completely automatic operation, resides in the fact of allowing cloth batches to be rolled up directly from rolls of great size, formed with a plurality of pieces of fabric mutually sewn together, which are supplied by a finishing unit. This has allowed a substantial reduction of the dead time required in such a unit for the steps of loading and discharging the rolls formed by the above-mentioned apparatus.

One of the most important advantages of this prior art apparatus has been due to the fact that it allowed obtaining cloth rolls of a reduced length, such as for the rolls generally used by the retailers.

The apparatus according to the present invention allows the same problem to be solved in a more satisfactory manner and in particular, further to eliminate some inconveniences of the prior apparatus, it results to have a more reliable operation and to provide for a higher production, while being of a simplified construction.

According to the basic feature of the apparatus of the present invention, it is provided with means for avoiding the formation of the so-called "fents", i.e. those remnant pieces of cloth which, due to their reduced length, must be sold under cost.

With the prior apparatus, as well as in the one being the object of the above-mentioned patent, it is known that the length of the wound batch of fabric is always the same, since the cutting operation is carried out at prefixed, regular time intervals by control means to be preset. As the feed rate of the fabric can be considered to be constant, it is clear that each cutting operation will be effected when a selected length of fabric has been fed forward. This involves some drawbacks due to the fact that the length of the cloth pieces forming the mentioned great size rolls is not always the same, although its variation range is restricted.

If we suppose to have a big cloth roll of e.g. 5000 m formed with pieces each of 200 m and the apparatus for forming rolls of fabric of shorter length has been preset to effect a cut every 50 m, the cutting operation will be carried out at the predetermined intervals, irrespective of the fact that the cloth is cut or not exactly along the seam between a piece and the following one. In practice, when a cloth piece is actually long 200 m, the apparatus will produce 4 rolls of 50 m each.

If the piece has a length lower than the nominal one, e.g. 195 m, the apparatus will give 4 rolls of 50 m. But on the last cloth roll, at 5 m from its end, there will be the seam of junction with the following piece. Therefore the last 5 m will have to be severed from the roll, thus forming the so-called fent.

If the piece has a length greater than the nominal one, e.g. 205 m, the same drawback occurs. Also in this case the apparatus gives 4 rolls of 50 m which can be used as such, the joining seam being on the following roll at 5 m from its leading edge. It is again necessary to eliminate 5 m of remnant.

In this second example the drawback is also noticed even if the roll obtained is the last because after the last cut carried out by the apparatus, there will be a remnant of 5 m.

SUMMARY OF THE INVENTION

The apparatus of the present invention, ensures to overcome this inconvenience, since the rolls obtained have a constant length, which only varies for the last roll of each piece, thereby terminating in coincidence with the seam between two adjoining pieces.

According to a further aspect of the present invention, this apparatus is particularly suitable to form rolls of both stretchable and non-stretchable fabrics, as well as rigid cloths, and is provided with means capable of preventing formation of pleats during the rolling up operation, especially for light weight fabrics.

Another advantage of the present apparatus is due to the fact of comprising means for obtaining cloth rolls having a particularly high compactedness, whereby the fabric during the transportation of the rolls will be free from strains or squeeze actions.

The apparatus for continuously forming cloth rolls from a fabric substantially in the shape of a band made of long pieces mutually joined together by sewing, comprises: a fabric feeding station; conveying means for the forward movement of the fabric; presetable control means for said conveying means, capable of causing the fabric to advance in sequence along paths of the same length; a measuring station for detecting the length of cloth advanced from the feeding station; a fabric rolling up station; a tube feeding means, each tube being the core of a roll to be formed, said means being provided to carry successively each tube from a magazine of the tubes to said rolling up station; a cutting station for transversely cutting the fabric; discharge means of the finished rolls, and is characterized by the fact that the fabric feeding station comprises first detecting means, upstream of the measuring station, being responsive to the seams between two any adjoining pieces to reset said presetable control means, and the measuring station comprises second detecting means also responsive to said seams to cause the fabric feed to stop when a seam comes to this station, there being further provided control means for causing the fabric to be fed forward by a fixed length corresponding to the distance between the measuring station and the cutting station.

BRIEF DESCRIPTION OF THE DRAWINGS

The characteristics and the advantages of the apparatus according to the invention will be apparent by the following description of a non-limiting embodiment thereof, with reference to the annexed drawings, wherein.

DETAILED DESCRIPTION OF THE PREFERRED EMBODIMENT

Figure 1A:
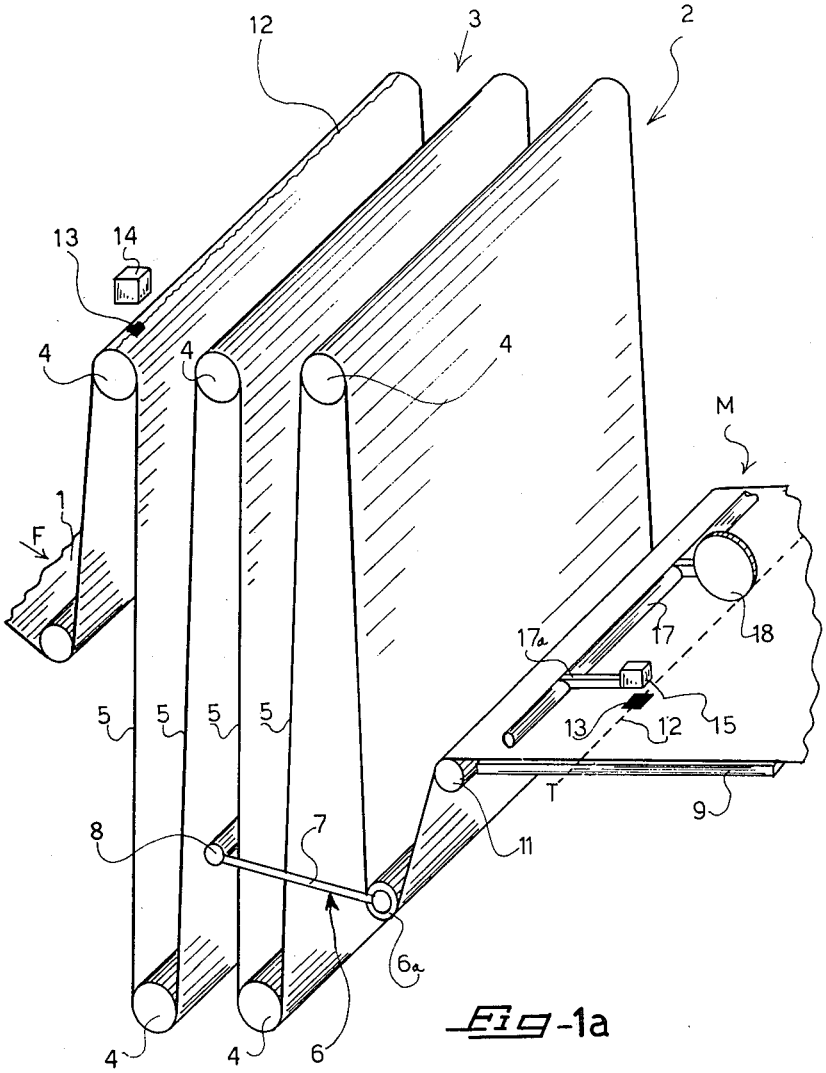
FIGS. 1*a* and 1*b* show, when joined together, a diagrammatic perspective view of the apparatus according to the present invention, wherein some particulars have been omitted for the sake of clearness of representation.
Figure 1B:
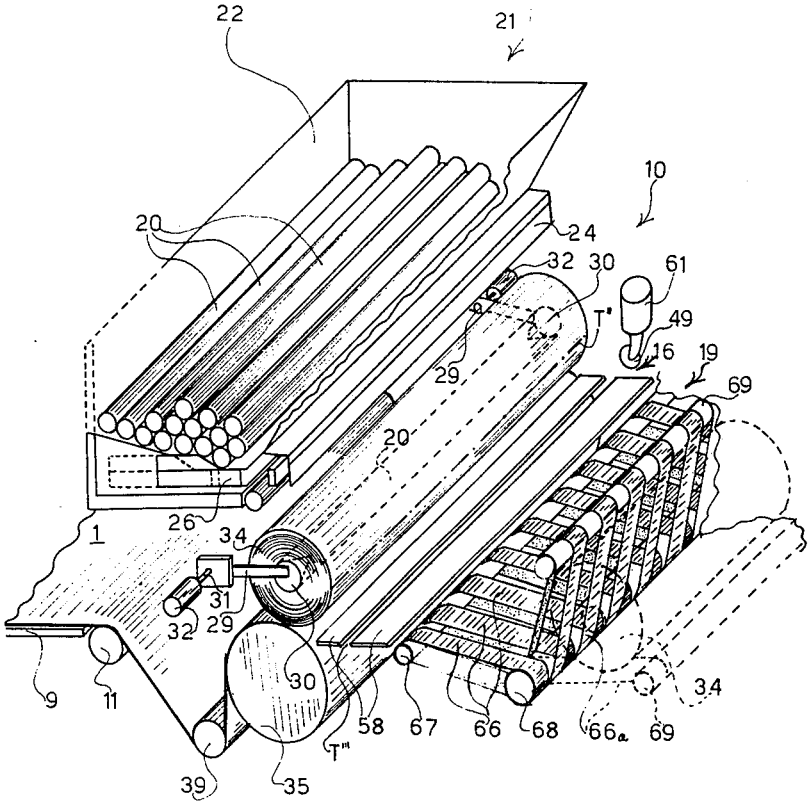

With reference to the FIGS. 1*a* and 1*b*, there is seen the fabric or cloth 1, e.g. from a finishing unit (not represented) or a big roll, which advances in the direction of arrow F toward a feeding station generally designated 2. The feeding station 2 comprises a cloth accumulator or scray 3 of the known type, substantially including a multiplicity of rollers 4 around which the cloth 1 is wound, thus forming a number of bends or webs 5. At the end of the cloth scray 3 a rocking lever device 6 is provided to maintain the necessary tensile stress in the cloth 1. This device 6 comprises a roller 6*a*, pivotedly mounted at the ends of a pair of arms 7 (only one shown in FIG. 1*a*) which are hingedly mounted at the opposite ends on a stationary support 8 placed at an intermediate zone of cloth scray 3. A not illustrated known means (such as a torsion spring) may be provided at the zone where arms 7 are hinged to the support 8 so as to impart a prefixed torque to the arms 7 in the direction of arrow G whereby the roller 6*a* can keep duly under tension the cloth 1 owing to this torque, not only its own weight.

The feeding station 2 comprises, downstream of the cloth scray 3, a slide plane 9 on which the fabric advances before entering a cloth rolling up station generally indicated 10. At the ends of the plane 9 a pair of idle rollers 11 are provided which are mounted for a free rotation on the apparatus frame (not shown).

The cloth 1, which is substantially in the form of a continuous band made of a plurality of long pieces of cloth joined together by seams 12 (only one visible in FIG. 1*a*), is fed from a big roll or a finishing unit. Between each piece and the following one, i.e. at each seam 12, a seam labeling element, referred to as 13, has been previously applied in whichsoever manner, being usually formed of a conventional autoadhesive phosphorescent paper. The presence of these seam labeling elements 13 at every seam 12, in combination with the detecting and control means with which the apparatus is provided and described hereinafter, will avoid the formation of the so-called fents or remnants.

This means, still with particular reference to FIGS. 1*a*, 1*b*, comprises a first photocell 14, positioned at the beginning of the cloth scray 3 and capable of being operated upon the passage of the element 13 indicating the presence of a seam 12.

The positioning of the first photocell 14 which, in the illustrated embodiment, is at the beginning of the cloth scray 3, could be advantageously chosen at an intermediate zone thereof without exceeding the object of the invention.

A second photocell 15 is provided in a cloth length measuring station M, positioned over the plane 9. This second photocell 15 is supported by a bracket 17*a* of a cross bar 17 overlying the plane 9. A metering device 18 is also mounted on the cross bar 17 for measuring the length of cloth past the measuring station M. The device 18, diagrammatically represented by a rotatory cylinder, permanently in contact with the fabric 1, is a known measuring device, already used in the prior art machines, thereby will be not described or illustrated in detail.

Still with particular reference to FIG. 1*b*, downstream of the cloth rolling up station 10, a cutting station 16 and a discharge station 19 for the finished rolls are successively provided, which will be described more in detail in the following.

According to one of the basic features of the apparatus of the present invention, the cutting station 16 is located downstream of the measuring station M, and this arrangement will enable to cut the fabric always along a seam 12, also by virtue of the photocells 14, 15.

The apparatus further comprises, between the measuring station M and the winding station 10, in the vicinity of the latter, a station 21 for feeding tubes 20, each of which is designed to be the supporting core of a cloth roll.

The operation of the apparatus according to the invention, with particular reference to the measuring and the cutting of the cloth 1 is the following.

It is assumed that the apparatus is provided with presetable known means (not shown), which is suitable to operate successive forward advancements of cloth 1, each of which corresponds to a selected constant length of fabric. Such a means is also obviously capable of actuating the cutting station 16 to cut cloth 1 at the end of said length. Now it is self-evident that the apparatus will operate in a fully automatic manner making rolls of cloth having all the same length, i.e. the preset value. Should the apparatus always operate automatically as just described, the above-mentioned drawbacks would occur, due to the unavoidable so-called fents, as it would be impossible in practice, at the end of each piece, to cause the cloth cutting to be coincident with the piece end, i.e. the seam.

By means of the apparatus according to the invention, this drawback is overcome mainly owing to the photocell 14 which, in presence of the seam 12, causes the automatic measuring of cloth 1 to be disabled, as well as to enable the photocell 15 which causes the cloth 1 to stop when the seam 12 has reached the position T. In particular, since the first photocell 14 is positioned upstream of the measuring station M, the disabling of the presetable means, i.e. the non-automatic operation of the apparatus, occurs before the seam reaches the measuring station M. The connection between the first photocell 14 and said presetable conveying means is not shown, since it may be of any type known to one skilled in the art. Similarly, suitable connections will be provided for detectors of a different type. The cloth scray 3 clearly allows the first photocell 14 to detect sufficiently in advance the presence of the element 13 indicating the passage of seam 12 before this reaches the measuring station M. Of course the labeling elements 13 could be of a different type from the above-mentioned such as magnetized or generally metallic labels, i.e. elements which can cause the actuation of a suitable electric, electronic or pneumatic detector replacing in this case the photocells 14 and 15. Merely holes or folds in the cloth could also be provided at the positions where a piece is sewn with another and has a different thickness owing to the seam itself, so as to be detected by a photocell or any other suitable electric or mechanical means.

Upon passage of the element 13 under the photocell 14, cloth 1 continues its movement forward in the direction of arrow F and it stops only as the element 13 passes under the second photocell 15. In fact the first photocell 14 not only causes the preset measuring means to be disabled, but also presets the second photocell 15 to stop the feeding of cloth 1 as the labeling element 13 is positioned thereunder. To this effect the second photocell 15 will be connected, in a known manner, (not shown) with a means for stopping the cloth feed. Also the electric connection between the first and the second photocell 14 and 15

It should be appreciated that the cloth 1 stops as the seam 12 coincides with the phantom line T from which the cloth to be wound in a roll is measured. As the seam reaches such a position and the cloth is stationary, a label is printed by means of a known labelling machine (not shown) which label indicates the length of the roll to be formed, and then the label is automatically bounded or pasted on the cloth. Obviously this labelling operation, could have already been carried out previously in a known automatic manner, without the intervention of the photocells, as the measuring presetable means has measured the desired constant length, at the end of which said means will directly cause the cloth 1 to stop.

In the above-mentioned example of pieces having a nominal length of 200 m, the apparatus practically operates as follows.

With a piece having an actual length equal to the nominal one, i.e. of 200 m, the apparatus automatically forms, by presetable means, three rolls of 50 m each, and the fourth roll, also of 50 m, is obtained as described before by actuation of photocells 14, 15.

In case that the piece has an actual length greater than the nominal length, e.g. 205 m, the operation will be the following.

The apparatus will provide for the automatic formation of three rolls of 50 m each, while the last one will be of 55 m for the following reason. According to the basic feature of the apparatus, the location of the photocell 14 upstream of the measuring station M allows the seam 12 to be detected before the same reaches said station, thus controlling the disabling of the presetable cloth measuring means. The second photocell 15 subsequently causes the cloth to stop as the seam has arrived to the position T. It appears that if the seam detection were not upstream, i.e. in advance, a remnant would unavoidably be formed.

In case of a piece having an actual length lower than the nominal one, e.g. 195 m, the operation will be substantially the same. The apparatus will automatically form three rolls of 50 m each, whereas the fourth will be obtained, through the intervention of the photocells 14, 15 which also in this case disable the automation means and cause the cloth to stop, respectively.

The subsequent feed of the cloth, after stop for the labelling operation, can be actuated in whichever known manner, such as by a control switch actuated by the labelling machine itself at the end of its operative cycle. The cloth is then caused to move forward along a constant length, e.g. by a known counter not represented, corresponding to the distance between the measuring station M and the cutting station 16. Thus the seam 12 is brought to the position of line T on the roll being formed, i.e. position T″. At this stage the apparatus stops again and the automatic step of discharge of the roll, cut of the fabric and the beginning of a fresh roll takes place.

A tube 20 designed to be the support and the core of the roll to be formed is fed by transfer thereof from the feeding station 21, which comprises a magazine 22 substantially formed with an upperly open, parallelepiped container body having at one side of its base an opening 23 for the discharge of one tube 20 at a time. The opening 23 is provided with a door 24 hingedly mounted by a pivot 25 to the magazine body 22. A spring means (not shown) is provided in any known manner co-operating with pivot 25 to keep the door 24 in the closed position illustrated in FIGS. 1 and 2, while allowing its temporary opening each time a tube 20 has to be removed from the tube feeding station 21.

The discharge of the tubes 20, one at a time, is provided by a slidable drawing 26 at the bottom of the magazine 22, illustrated by a full line at the closed position and a phantom line at the open position. The drawing 26, to facilitate the discharge of tubes 20, is formed with a chute-shaped wall 27 on which the tubes 20 roll down one at a time by gravity, and reach the position at the opening 23. The reciprocating movements of the drawing 26 are obtained by a piston 28 arranged rearward of it, having the cylinder fixed to the rear wall of the container 22.

Figure 2:
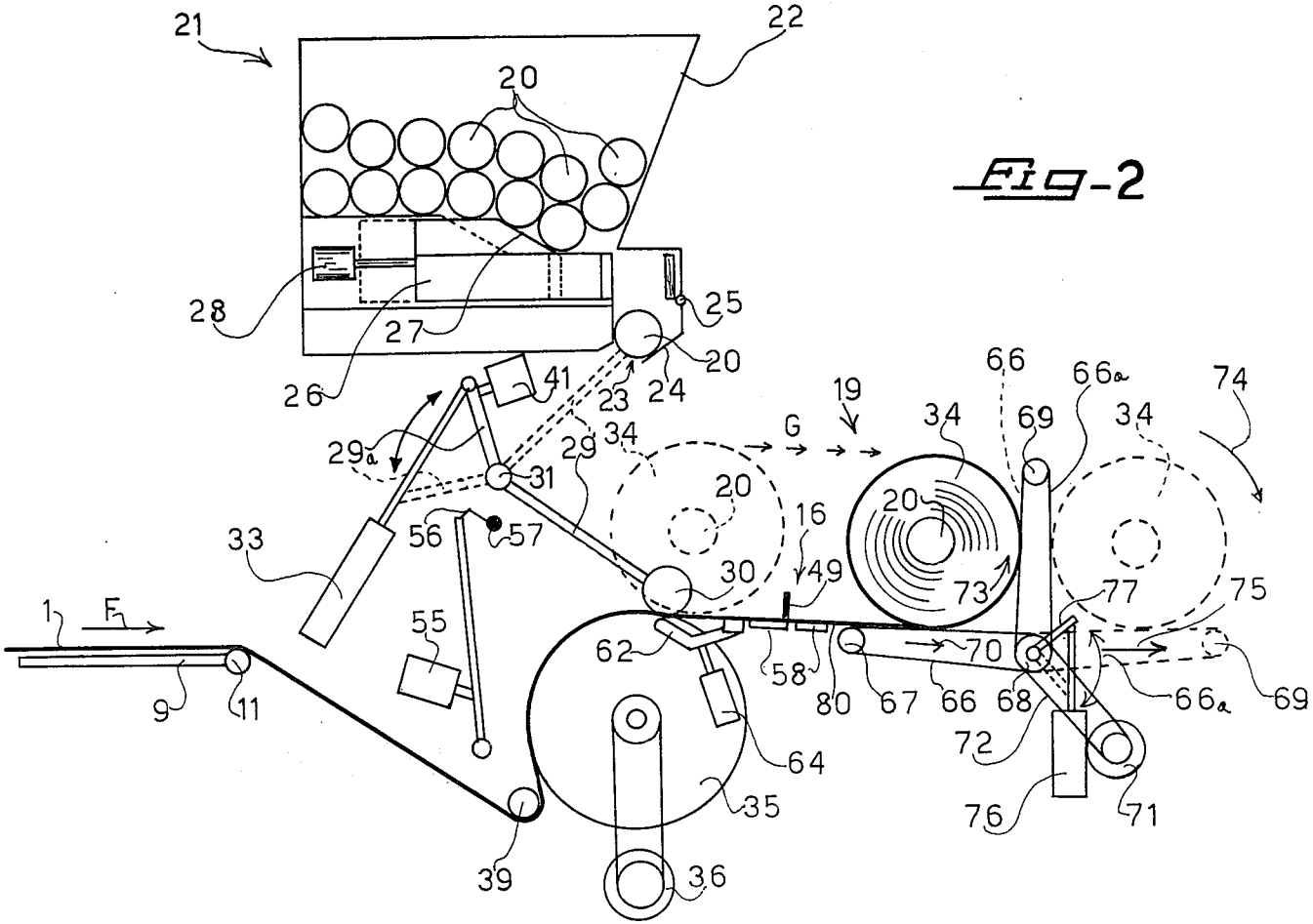
FIG. 2 shows a diagrammatic side view of the end portion of the apparatus at the beginning of the step of discharging a finished roll.

With particular reference to FIGS. 1, 2, the discharge of a tube 20 from the feeding station 21 and its positioning in the rolling up station 10 is carried out as follows.

A pair of arms 29, provided at the winding station 10, parallel to the path of the cloth 1 and positioned over one edge of the cloth itself, have at an end thereof a conical mandrel 30 adapted to fit the corresponding end of tube 20. At the opposite end the arms 29 are hinged to the apparatus frame through a pivot 31, so as to be able to rotate upwards and downwards to engage a tube 20 from the magazine 22 and to position the same in the station 10. The arms 29 are also transversely moveable with respect to the path of cloth 1, so as to allow the insertion in and the release of the conical mandrels from the tube 20. To control this latter movement of the arms 29, each of these is associate with a piston 32 suitable to move the pivot 31, which will slide on the apparatus frame in a proper manner. The upward and downward pivoting of the arms 29 is caused by a pair of pistons 33 having the cylinder fixed to the apparatus frame, the rod of which is pivotedly mounted at the end of an extension **29*a* of the arms 29. The lowered and the lifted position of the arms 29 and relevant extension 29*a* are respectively shown by full and phantom lines in FIG. 2. A tube 20 is removed from the magazine 22 by moving upward the arms 29 through the pistons 33 until the mandrels 30 are positioned at the opening 23. Subsequently, by the cylinders 32, the arms 29 are caused to approach, so that the ends of the mandrels 30 fit in the corresponding ends of the tube 20. Once the tube 20 has been caught, the pistons 33 cause the arms 29 to effect a clockwise rotation to release tube 20 from the magazine 22 against the resistance of the door 24 for the subsequent path to the rolling up station 10**.

A finished cloth roll 34 (FIGS. 1, 2) is discharged by actuating the pistons 32, which cause the transverse movement of the arms 29, thereby releasing the conical mandrels 30 from the ends of tube 20. Then the roll 34 moves, by its own weight, to the discharge station 19 owing to the surface on which it rolls being sloping to this station.

In FIG. 2 the roll 34 is represented in phantom at the moment when the arms 29 are spaced apart and by full lines in the position taken at the discharge station 19 reached through a path in the direction of the arrows G.

Figure 6:
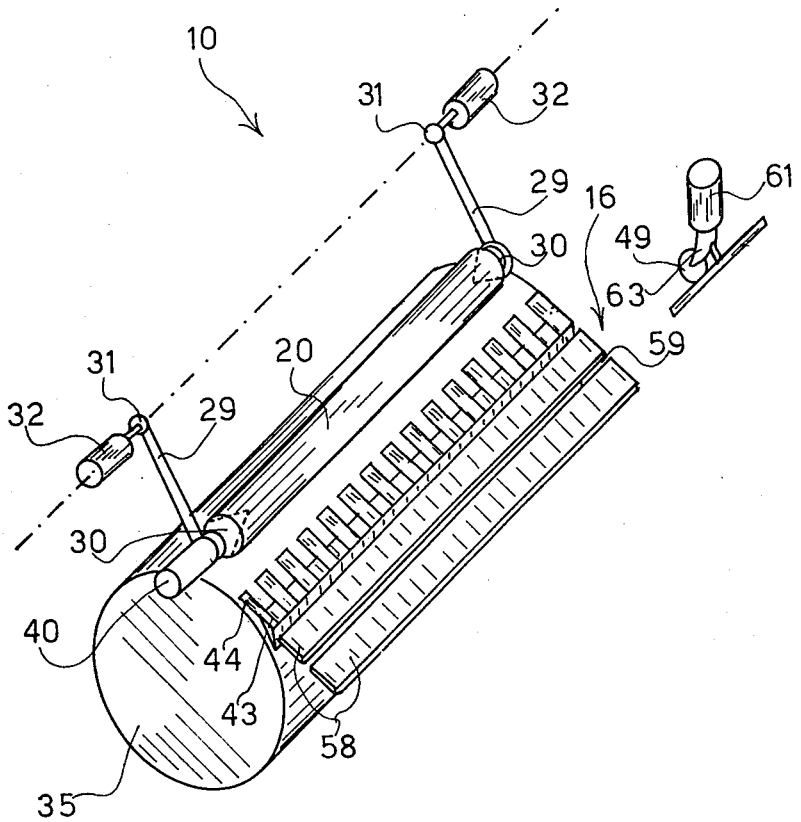
FIG. 6 shows a diagrammatic perspective view of the cloth winding and cutting means.

The cutting station 16 (FIGS. 1*b*, 2, 6) conventionally comprises a cutting table 58 having a longitudinal groove 59 in which a rotary blade 49 traverses, being driven by a motor 61. The support means of the blade 49 and the motor 61 for allowing their movements across the fabric 1 is not shown, being in the reach of anyone skilled in the art and also being already described in the abovementioned patent.

The start of the rotation and traverse of the blade 49 is operated as the seam 12 reaches from the position T″ on the roll 34 the position T‴ upon releasing of the roll 34 from the arms 29 and has come to the discharge station 19. Since the length by which the cloth 1 advances is fixed, controlled by the counter device after the labelling operation, the seam 12 in any case will reach a position over the groove 59. Thus the cutting blade 49 will always cut the cloth 1 along the seam between two adjacent pieces.

This feature is independent from the diameter of the formed roll as the length by which the cloth 1 advances is always the same and corresponds, as already stated, to the distance between lines T and T‴. According to the diameter of roll 34 the position of the seam 12 thereon will vary, i.e. the line T″ will be shifted upwardly or downwardly along the edge of the roll 34 if the latter has a diameter respectively smaller or larger than that represented, but the seam 12 will be always coincident, on the plane 58, with the groove 59.

Once the blade 49 has cut the cloth 1, the finished roll is discharged and at the same time a fresh one is initiated. The winding to form a new roll begins as follows. As the tube 20 comes into contact with the portion of fabric 1 which is present in the rolling station 10, a driving roller 35 supported for rotation by the apparatus frame is caused to rotate, driven by a motor means 36. A smaller roller 39 is provided at the zone where the cloth 1 contacts the roller 35 to give the cloth 1 the necessary stretch for an even winding on the roller 35.

Figure 4A:
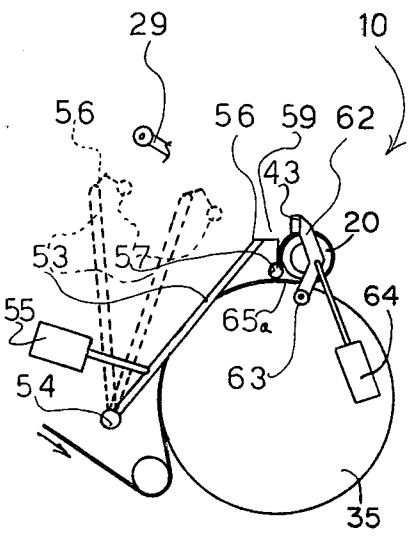
FIGS. 3, 4 and 4*a* show a diagrammatic side view representing the initial stage of formation of the fabric roll by rolling up means for winding the end edge of the cloth around the tube.
Figure 4:
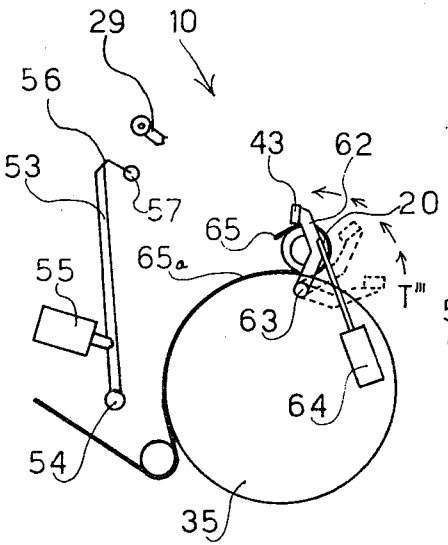
Figure 3:
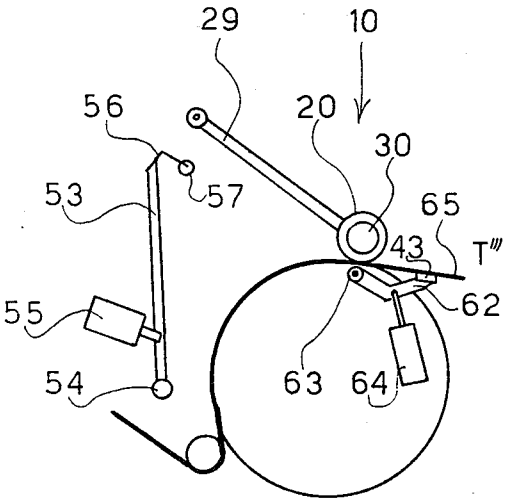

With particular reference to FIGS. 3, 4, 4*a*, the apparatus of the invention comprises, in the rolling up station 10, means for causing the leading end of the new roll to be folded on the tube 20.

Such a means, diagrammatically shown in said figures, comprises on each side of the driving roller 35 one arm 62 pivotedly mounted at an end on a pin 63 for a counterclockwise rotation under the action of a driving piston 64 from the position illustrated in FIG. 3 to the position of FIG. 4*a*, to bring the leading end 65 of the new roll to bend around the tube 20. In particular the end 65, which initially is in the position T‴ of FIG. 3 is gradually brought to the position shown in FIG. 4*a*, where this end portion 65 is wound on the tube 20. The ends of arms 62 entering into contact with the cloth 1 will be advantageously mutually connected by a cross bar 43 (FIGS. 3 to 4*a*) having a length greater than the tube 20. Thus the edge 65 will be lifted and evenly folded along all its width.

If the edge 65, as shown in FIGS. 4, 4*a*, is longer than the periphery of tube 20, its front portion will undergo an undesired folding designated 65*a* in FIGS. 4, 4*a*, which then must be discarded. To avoid this inconvenience the apparatus may be provided with (not represented means) adapted to overcome the drawback. It will be sufficient for this purpose to provide means which at the end of the cloth cutting operation causes a temporary counterclockwise rotation of the driving roller 35, so as to pull back the position of the leading end 65. Thus the end portion will be withdrawn with respect to the position T‴ to cause the end portion 65 to completely wind around the tube 20. The roll will start to be formed exactly as above-described.

Figure 4B:
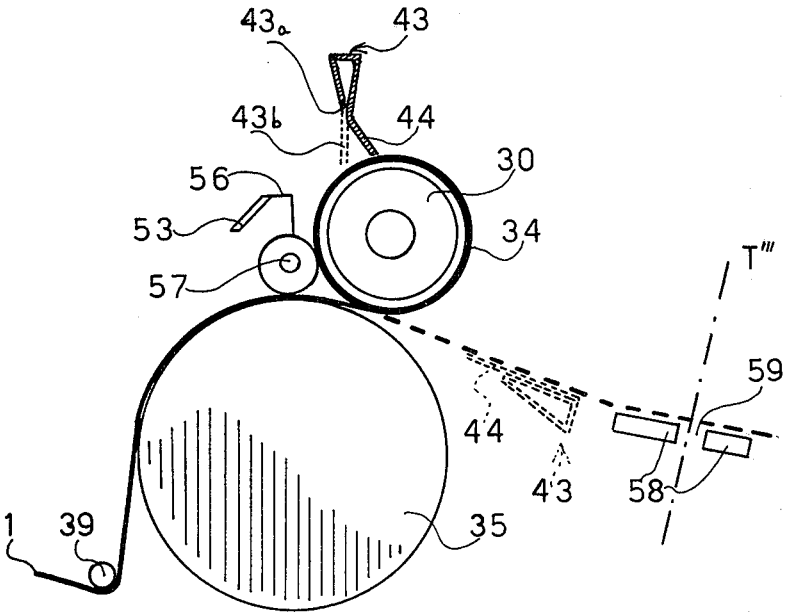
FIG. 4*b* shows a diagrammatic side view, similar to FIGS. 3, 4 and 4*a*, representing more in detail, in a larger scale, the means originating the formation of a roll.

Still with particular reference to FIGS. 3, 4, 4*a* but also to FIG. 4*b*, the apparatus according to the present invention comprises means for avoiding the formation of pleats, especially in the initial stage of the roll formation, and causing the cloth to wind in an extremely compact manner.

With particular reference to FIG. 4*b*, this means substantially comprises the cross bar 43 joining the ends of arms 62 and according to the positions assumed by these arms (FIGS. 3, 4, 4*a*) will reach the upper end position (full line) and lower end position (phantom line) shown at FIG. 4*b*.

Figure 7:
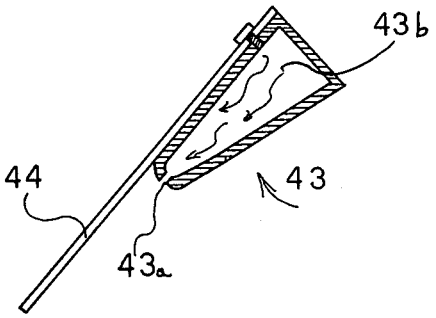
FIG. 7 shows, in cross-section and on a larger scale, means in the cloth rolling up station, also represented in FIG. 4*b*, for causing the fabric to be fastened to the tube at the beginning of the roll formation.

As it appears better from FIG. 7 where this bar 43 is shown in detail, the latter is a tubular bar with a substantially triangular cross-section, which is formed along all its length with spring foils 44 adapted to press with their ends on the fabric during the winding round the tube.

As it results in particular from FIG. 4*b*, the bar 43 and the spring foils 44 in the position represented in phantom are suitable to form a rolling chute for the finished roll, whereas in the upper position represented by a full line, provide a first means for joining the cloth to the roll being formed. In fact in this position it should be noted that the bar 43 has a double function. According to the invention the bar 43 is provided at its lower edge with a plurality of equally spaced holes 43*a* through which compressed air is discharged through streams 43*b* to the fabric being wound. The cross bar 43 will be connected for this purpose in any known manner, such as by a flexible hose, to a source of compressed air, not shown. In addition, the spring foils 44, adhering to the cloth 1, are bent and impart a pressure action on the fabric thus causing it to uniformly fit to the roll.

It is clear that the position of the spring foils 44 on the bar 43 in relationship with the holes 43*a* will be such as to allow the air passage when foils 44 are bent. To this effect it will be sufficient to provide alternately a foil 44 and a hole 43*a*, in order that air can flow across the space between two adjacent foils 44. At this stage, to complete the action of both compressed air and foils 44 onto the cloth 1, further means is provided for causing the cloth to mate with the roll being formed. Such a means operates after both the lifting step of the cross bar 43 and the discharge of compressed air thereto are terminated.

This means comprises a pair of arms 53 (FIGS. 3, 4, 4*a*) positioned laterally of the roll 35 upstream of the rolling up station 10, which are suitable to assume a rest position being represented in FIGS. 3, 4 and an operating position being represented in FIG. 4*a* by a full line, with their end rotating toward the roll to be formed, in the direction of arrows H. Each arm 53 is pivotedly mounted through a pin 54 to the apparatus frame. Their movement is obtained by a pair of pistons 55, each having its piston rod in pivotable engagement with arm 53.

The actual means for the adhesion of the fabric on the tube 20 initially and subsequently on the roll being formed is provided at the free end of arms 53 and comprises a spring foil 56 fixed to the end of arm 53, having thereon equally spaced rotatory small wheels to engage cloth 1 as the arms 53 are moved to the operating position of FIG. 4*a*. Due to the elasticity of the foil 56 the small wheels 57 are adapted to be pressed under a sensible force on the cloth 1 to urge this latter as much as possible against the cardboard tube, thus increasing the adhesion thereon by friction.

Once obtained the folding and adhesion of the end portion 65 of cloth 1 on the tube 20, the actual step of rolling up initiates, wherein the driving roller 35 rotates clockwise thus feeding the cloth and causing the cardboard tube 20 to rotate, round which a new roll is generated.

Immediately afterwards the pistons 55 and 64 reverse their stroke so that the small wheels 57 and bar 43 are disengaged by the cloth thus enabling the just initiated roll to increase its diameter. As a consequence the aim of the bar 43 is that of winding the end portion 65 on the tube 20, whereas the set of wheels 57 has the purpose of imparting a frictional action to the fabric against the tube to cause the cloth to roll up on the tube itself. It has been noticed however that a thus obtained roll, depending upon the type of fabric employed, may still show two defects:

1. Poor compactness;
2. Presence of pleats.

In order to remove these defects the apparatus is provided with means for imparting to the cloth an intermittent drawing action. This means operates at the beginning of the roll formation, in particular immediately after the wheels 57 and the bar 43 have been spaced from cloth 1, as shown in FIG. 3. It comprises for each arm 29 a piston 41 acting on the tail portion 29*a* of the arm 29 against the action of piston 33.

Figure 5:
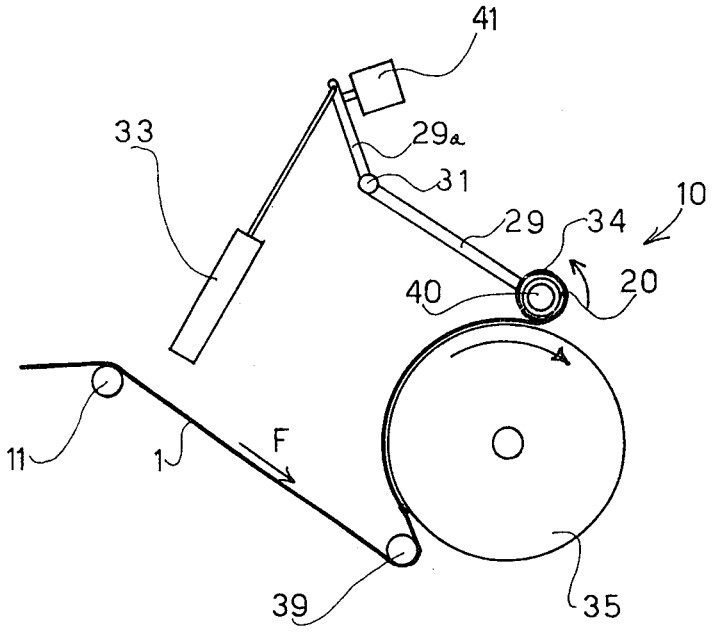
FIGS. 5 and 5*a* show a diagrammatic side view of the cloth winding station during the formation of a roll.
Figure 5A:
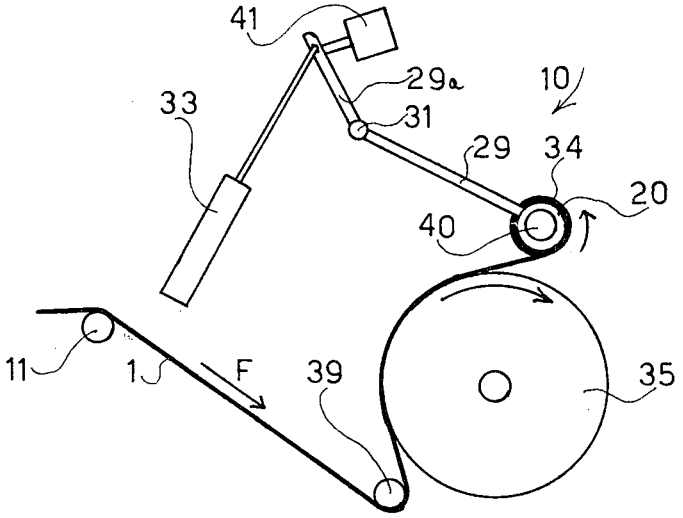

The operation of the pistons 41 causes a counterclockwise rotation of the arms 29, so as to move the roll 34 upwardly with respect to the roller 35, thus exerting a tractive action on the cloth 1 and improving the conditions of compactness of the roll. In FIGS. 5, 5*a* the step of lifting the roll 34 by piston 41 is shown. In particular in FIG. 5 the roll 34 is in its lowered position, i.e. in contact with the roller 35 since the piston 41 is at rest, and in FIG. 5*a* the roll 34 is lifted since the pistons 41 have been actuated.

According to the invention, as long as the roll 34 is lifted, the cloth 1 is no longer caused to be fed by the driving roller 35, but owing to a motor 40 being coaxial with one of the mandrels 30. Motor 40 may be of the pneumatic type and in any case a flexible, low-power motor. It will have, according to the invention, a peripheral speed greater than the driving roller 35. Thus during the time periods when the roll 34 is in spaced relationship with roller 35, the motor 40 will impart the tube 20 a peripheral speed higher than the roller 35, further improving the compactness conditions of the finished roll. Obviously the motor 40 will be provided with known speed control devices, the speed being consequently caused to vary according to the type and nature of the fabric. These devices are not shown in detail since may be directly included in the motor 40.

Advantageously intermittent control means will be provided to operate the pistons for lifting the roll 34 so as to render periodical, thereby more efficient the drawing action on the cloth. Obviously the above-mentioned operation can further let the possibly loose cloth between roller 35 and roll 34 to be taken up in tension.

As the pistons 41 return to rest (FIG. 5) the arms 29 are lowered again thus bringing again the roll 34 into contact with the roller 35. It is clear that the roll 34 could be lifted in a different way.

The roll is discharged into a collecting magazine or suitable container through the discharge station 19 now described with particular reference to FIGS. 1*b*, 2. The roll 34 has arrived therein by rolling along the chute formed by the bar 43 and the surface 58 of the cutting station 16 due to its own weight.

First of all it should be appreciated that the discharge station 19 allows not only the actual discharge of the roll 34, but also the completion of the winding thereof so that the end portion 80 will be completely wound on the roll. Upon cutting, the portion 80 is in fact partially positioned on the surface 58 as it appears in particular from FIG. 2.

The discharge station 19 is for this purpose formed of two multiplicities of belts 66, 66*a* placed substantially at right angles and alternately wound around shafts 67, 68, 69, the shaft 68 being common since both belts 66 and 66*a* are mounted thereon.

At the position represented by a full line the belts provide a support and stop plane for the roll 34 from the cutting station 16. First of all they cause the portion 80 of the roll 34 to completely wind and, for this purpose, are brought into rotation in the direction of arrow 70 (FIG. 2) by a motor 71 connected, through a belt 72, to the shaft 68 common to the belts 66, 66*a*. Thus the roll 34 is initially subject to a counterclockwise rotation in the direction of the arrow 73 so as to complete its formation.

The assembly of belts 66, 66*a* is supported by a frame not shown which is caused to rotate by 90° in the direction of arrows 74 for the final discharge of the roll 34, whereby the belts 66*a* will arrive at the position illustrated in phantom, in which also the roll is represented in phantom. Thereat the belts 66, driven again by the motor 71 in the sense of arrow 75, provide a conveyor belt for the roll 34, which is thus discharged to the above-mentioned collecting station.

In the illustrated embodiment the rotation of the frame bearing the belts 66, 66*a* is obtained by means of a pair of pistons 76, one for each end of the shaft 68, connected to the end of the shaft 68 by means of a link rod 77.

Upon discharging of the roll 34, the frame bearing the belts 66, 66*a* is brought again, always under action of the pistons 76, to the position shown by a full line, wherein the belts are adapted to receive another roll.

It is obvious that variations and/or modifications will be made to the described and illustrated embodiment of the apparatus according to the invention without therefor exceeding the protective scope of the invention itself.

Finally it is also clear that in the apparatus of the present invention all the devices, means and connections necessary to ensure the co-operation and synchronization of the various operating steps of the apparatus will be provided, e.g. relays, limit switches, control valves, timers and the like. All these devices and means have been neither shown nor described in detail as they are easily feasible by one skilled in the art.

What we claim is:

1. An automatic apparatus for continuously forming cloth rolls from a fabric substantially in the shape of a band made of a multiplicity of pieces mutually joined together by sewing, comprising a cloth feeding station; conveying means for the forward movement of the cloth; presetable control means for said conveying means capable of causing the cloth to advance successively along paths of the same length; a measuring station for detecting the length of cloth advanced from the feeding station; a cloth rolling up station; a tube feeding means, each tube being the core of a roll to be formed, said means being provided to carry successively each tube from a tube magazine to said rolling up station; a cutting station for transversely cutting the cloth; discharge means for the finished rolls, wherein the cloth feeding station comprises first detecting means upstream of the measuring station being responsive to the seams between two adjoining pieces to disable said presetable control means, the measuring station comprising second detecting means enabled by said first detecting means to be also responsive to said seams to cause the cloth feed to stop once a seam arrives at this station, there being further provided control means for causing the cloth to be fed forward along a fixed length corresponding to the distance between the measuring station and the cutting station.

2. An automatic apparatus according to claim 1 wherein, upstream of the measuring station there is provided a cloth scray said first detecting means being located substantially at the inlet of said cloth scray.

3. An automatic apparatus according to claim 1, wherein the cutting station is arranged downstream of the rolling up station.

4. An automatic apparatus according to claim 1, wherein the tube feeding means comprises arms pivotably mounted in a substantially vertical plane and supporting the cloth roll.

5. An automatic apparatus according to claim 1, wherein a further conveying means is provided in the rolling up station to bring the leading edge of the cloth upon cutting onto another tube supplied by said tube feeding means.

6. An automatic apparatus according to claim 5, wherein said further conveying means comprises a tubular cross bar having an edge subject to an elastic deformation, supported by arms positioned laterally of the cloth for its positioning over said tube, whereby said deformable edge is urged against the cloth.

7. An automatic apparatus according to claim 6, wherein said deformable edge of the cross bar is formed with a plurality of spring foils in spaced relationship.

8. An automatic apparatus according to claim 7, wherein said tubular bar is connected with a source of compressed air and comprises at the zones of its edge between the spring foils holes for the discharge of compressed air towards the leading edge portion.

9. An automatic apparatus according to claim 1, further comprising means for the adhesion of the leading edge of the cloth on said tube.

10. An automatic apparatus according to claim 9, wherein said adhesion means comprises a multiplicity of small wheels on a flexible rod mounted on supporting means pivotable in a substantially vertical plane.

11. An automatic apparatus according to claim 4, wherein a means is provided to cause a periodical lifting of the roll to be formed, with respect to a cloth driving roller.

12. An automatic apparatus according to claim 11, wherein said means comprises piston means operating on arms for supporting the roll.

13. An automatic apparatus according to claim 12, wherein on at least one of the arms there is mounted a motor means to drive the tube to rotation with a peripheral speed which is greater than said roller.

14. An automatic apparatus according to claim 1, wherein the roll discharge station substantially comprises an assembly of first and second multiplicities of belts substantially at right angles to one another and alternately wound around three shafts, one of which is common to said belts being driven by an actuating motor.

15. An automatic apparatus according to claim 14, wherein the assembly of belts is tiltable for discharging the finished roll.

* * * * *